United States Patent [19]

Paurat

[11] 3,998,493

[45] Dec. 21, 1976

[54] COMBINED MILLING AND IMPACT APPARATUS FOR TUNNELING

[76] Inventor: Friedrich Wilhelm Paurat, Alte Hunxer Strasse 45, 4222 Friedrichsfeld (NDRRH.), Germany

[22] Filed: June 25, 1975

[21] Appl. No.: 590,083

[30] Foreign Application Priority Data

June 26, 1974 Germany ..... 2430606

[52] U.S. Cl. ..... 299/56; 299/18; 299/66; 299/70; 299/71; 299/75; 173/52

[51] Int. Cl.[2] ..... E21D 9/10

[58] Field of Search ..... 299/18, 56, 65, 66, 299/71, 73, 75, 30–33, 44, 69, 70, 57; 173/52

[56] References Cited

UNITED STATES PATENTS

| | | | |
|---|---|---|---|
| 1,439,666 | 12/1922 | Foss | 299/44 |
| 2,329,875 | 9/1943 | Cartlidge | 299/65 |
| 2,531,072 | 11/1950 | Merchant | 299/70 X |
| 2,750,178 | 6/1956 | McCallum | 299/65 X |
| 2,980,409 | 4/1961 | Goodrich | 299/66 X |
| 3,064,958 | 11/1962 | Osgood | 299/73 X |
| 3,128,998 | 4/1964 | Sibley | 299/71 X |

*Primary Examiner*—Ernest R. Purser
*Attorney, Agent, or Firm*—Karl F. Ross; Herbert Dubno

[57] ABSTRACT

A support displaceable along a tunnel or gallery floor by means of a caterpillar drive is provided with a rotatable milling tool that can be brought into engagement with a lower portion of a face wall and with a reciprocal hammer engageable with an upper portion of the wall. The miller is operated to cut or grind material off the lower portion so as to undercut the wall. Then the hammer is operated to chip or break off the upper portion of the undercut wall. Both the miller and hammer are mounted on adjustable and directable arms. The loosened rock is carried off by a scoop-transport belt arrangement.

5 Claims, 4 Drawing Figures

10
11
2
20
21
21a
21b
21d
14
9
8
7
1
12
13
17
23
22
3
3a
4
5
6
15
III 10
11
2
14
7
1
21b
17
18
12
16
13
3
6
4

COMBINED MILLING AND IMPACT APPARATUS FOR TUNNELING

FIELD OF THE INVENTION

The present invention relates to a tunneling apparatus. More particularly this invention concerns the mining of coal and the like.

BACKGROUND OF THE INVENTION

In a known mining or tunneling method a cutter head works the whole cross-section or face wall of a drift, tunnel, or heading. The rock is freed entirely by cutting which is an expensive method with high tool wear. Tunneling machines used for known methods are so called part-section machines where the cutter head, equipped with teeth, sweeps over the entire area of the face wall. Such tunneling machines have limited use if the mineral or rock to be mined is too hard or too abrasive. The tool wear exceeds any economically justified proportion, the harder the rock the lower the efficiency.

Machines not constructed for the purpose of tunneling are used whereby supporters carry heavy hydraulic hammers with a high knocking energy (see my U.S. Pat. No. 3,729,056 issued Apr. 24, 1973). These hammers are mostly attached to the arms of hydraulic excavators. Such equipment has also been used in coal mining. The hydraulic hammers of these machines first work at the soft coal in sight and then break down the solid rock after knocking off the loose material from the ceiling for safety reasons. The aforementioned hydraulic hammers are generally not suitable for working at the face wall, and therefore have no influence on solving the need for equipment suitable for driving drifts and similar enclosed below-ground hollow spaces.

OBJECTS OF THE INVENTION

It is therefore an object of the present invention to provide an improved apparatus for tunneling or otherwise excavating enclosed below ground hollow spaces.

Another object is the provision of a suitable tunneling apparatus which can be used with good effect for the given method where a conventional apparatus is useless or of limited versatility.

SUMMARY OF THE INVENTION

The above objects are attained according to the present invention by a method of driving tunnels, drifts, headings, or similar enclosed below-ground areas, with a given cross-section, whereby the face wall of the tunnel is worked with a rotating cutter head. The present invention teaches to first create one or more cavities in the lower part of the face wall with a rotating cutter head and then to free the material of the overlaying part of the face wall by knocking it down. With this system only a very small part of the face wall needs to be milled. The larger part of the heading falls in big pieces. Therefore the specific grinding and crushing process becomes less, considerable savings in energy expenditure and tool wear are achieved, and the excavation value per unit time increases.

According to another feature of this invention the aforementioned method can be carried out with an integrated gallery-driving apparatus which is equipped for the cutting and knocking treatment of the drift face wall, whereby the tools for cutting and knocking work together.

The integrated gallery-driving apparatus comprises a caterpillar-type driving gear, a milling arm with a cutter head and a hauling installation for removal of the freed rock with a loader below the cutter head of the miller. The milling arm with its cutterhead are pivotal about vertical and horizontal axes.

According to the present invention the caterpillar-type drive carries a hammering platform with a motor driven, withdrawable working platform movable over the lowered milling arm toward and away from the drift face wall, the working platform carries a hydraulic hammer by means of a hinged arm. The milling arm with its cutter head is in a known manner equipped with its own drive mostly housed in the milling arm itself. The hydraulic hammer is also equipped with a known drive which is preferably housed in a part of the hinged arm.

In order that the face wall can be worked at different levels above the floor level according to the method of the present invention the hinged arm preferably has two sections connected at a joint, one of the sections being hinged to the working platform and the other section carrying the hydraulic hammer. It is generally sufficient for the hinged arm, with the tunneling apparatus in its normal position, to have joints for pivoting about a horizontal axis, and to be together with the hammering or working platform pivotal about a vertical axis. This gives enough freedom of movement for positioning the hydraulic hammer at any point on the face wall as well as employing an optimum working direction for the hydraulic hammer. There is also the possibilty of installing the hinged arm including the working platform so as to be pivotal about a horizontal axis.

The tilting of the milling arm, and the described movements of the hinged arm of the tunneling apparatus of the present invention are motor driven. This can be done in different ways. A simple and safely functioning construction is to provide for the milling arm, the hinged arm, and the sections of the hinged arm, hydraulic rams connected to a hydraulic control circuit whose pump can be connected to the engine of the caterpillar-type drive.

From a technical viewpoint the advantages achieved are such that for the construction of the integrated apparatus tested and proven machine units can be used, and combined in the described fashion, in order to work the face wall with a combined functioning of the milling head and the hydraulic hammer, and to free the rock by creating cavities, and knocking down the overhanging parts. The removal of the rock takes place with the aforementioned loader connected to a hauling device, preferably installed between the trails of the drive gear.

DESCRIPTION OF THE DRAWING

The above and other objects, features, and advantages will become apparent from the following description, reference being made to the accompanying drawing in which.

SPECIFIC DESCRIPTION

Figure 4:
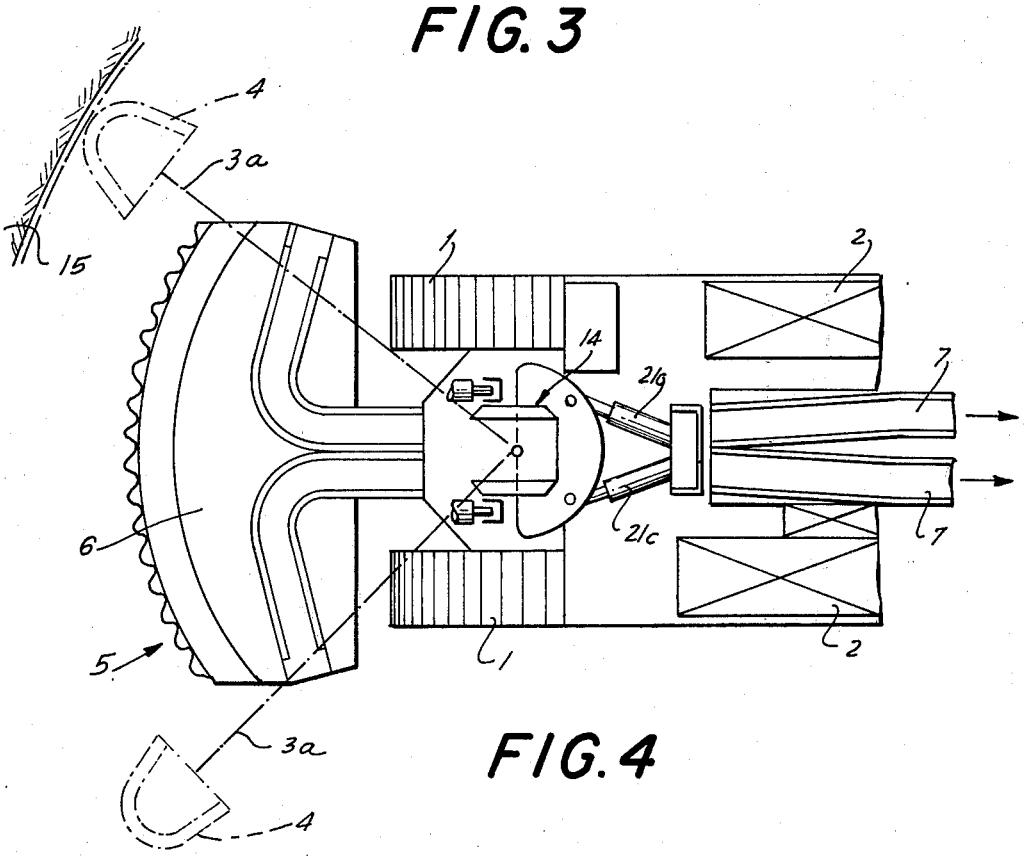
FIG. 4 is a top view of the apparatus shown in FIG. 1 with the upper part of the apparatus removed.

The gallery driving apparatus shown in FIGS. 1 to 4 basically comprises a caterpillar-type driving gear 1 with an engine 2, a milling arm 3 with a cutter head 4, and a scoop 5 for removal of freed rock. The scoop arrangement 5 has a loader 6 and connected thereto a band conveyor 7 and is located below the milling arm 3 and cutter head 4, as best seen in FIG. 4. A hydraulic motor 22 is provided in the arm 3 to rotate the miller 4.

Figure 1:
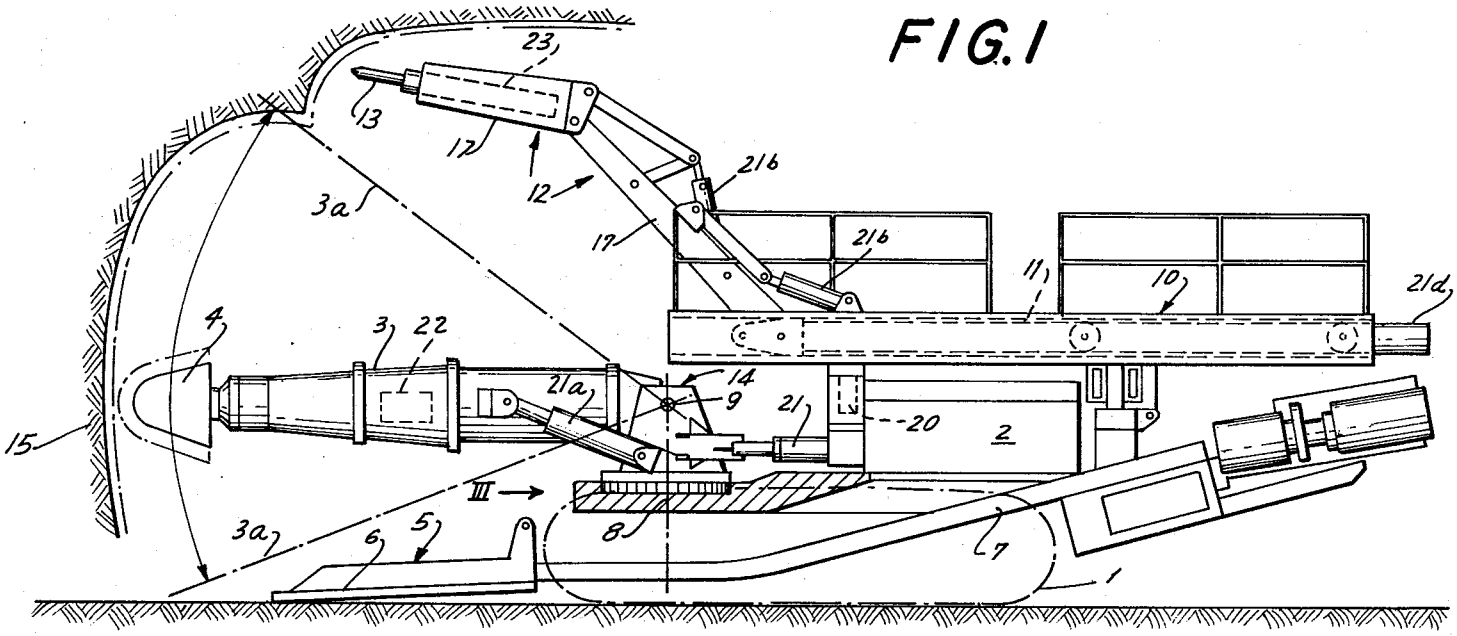
FIG. 1 is a side elevational view of an apparatus according to the present invention.
Figure 2:
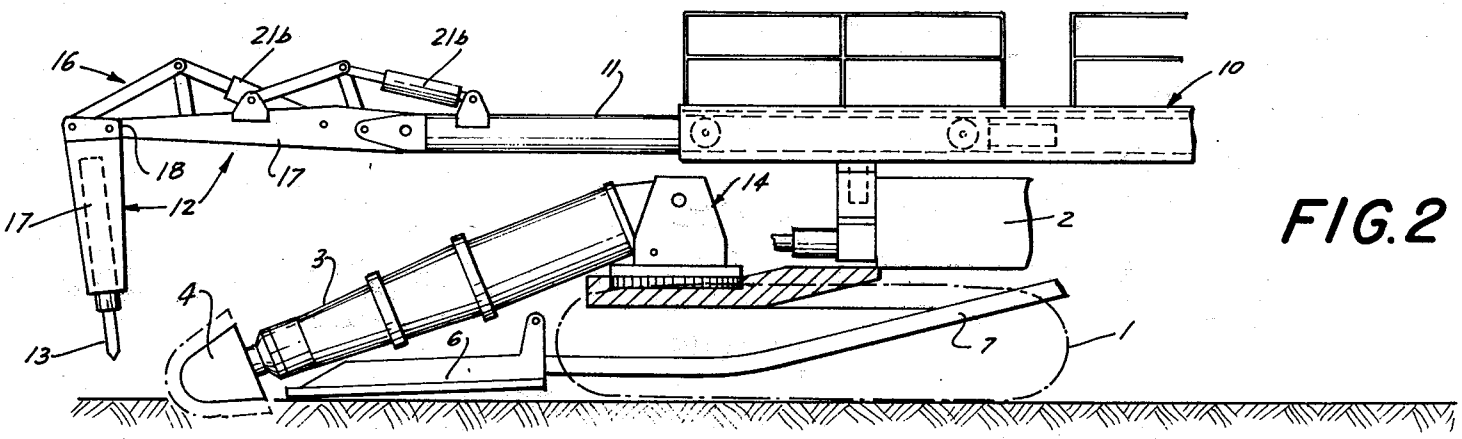
FIG. 2 is part of the apparatus shown in FIG. 1 in a different working position.
Figure 3:
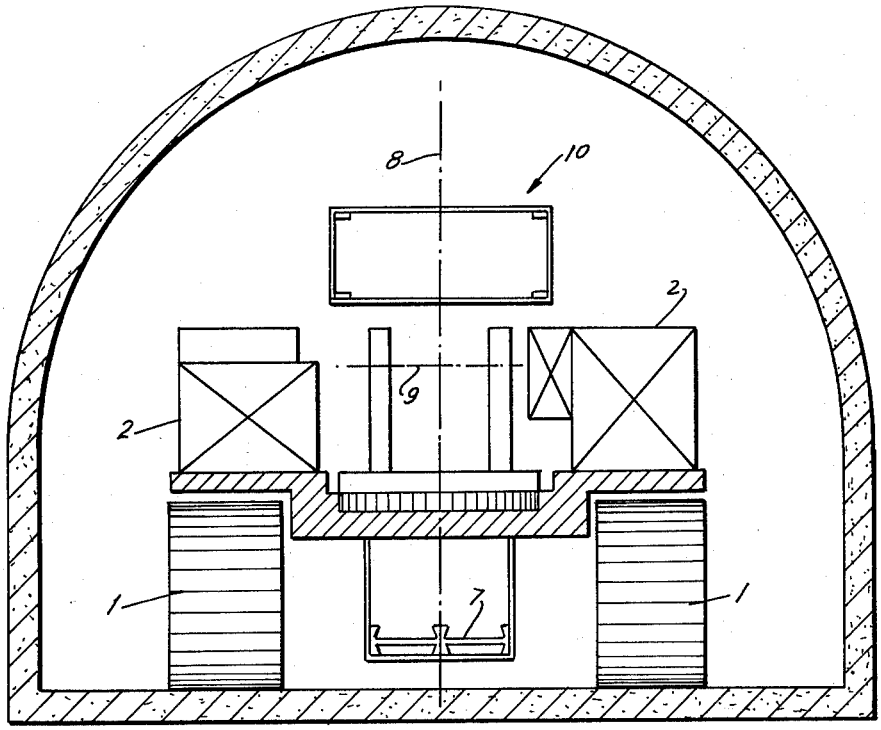
FIG. 3 is an elevational view of the apparatus taken in the direction of arrow III of FIG. 1.

The milling arm 3 with its cutter head 4 are pivotal about a vertical axis 8 and a horizontal axis 9. The different positions which can be taken by the milling arm 3 are illustrated with dot-dash lines 3*a* in FIGS. 1 and 4. The caterpillar-type drive 1 supports a hammering platform 10 with a working platform 11 which carries on an articulated two-part arm 12 a hydraulic hammer 13. The hammering platform 10 and the working platform 11 are sufficiently high to project above the tower 14 of the milling arm 3. Otherwise the layout is such that the motor-driven withdrawable working platform 11 with hinged arm 12, and hydraulic hammer 13, is movable on the hammering platform over the lowered milling arm toward the face wall of the tunnel being made. FIG. 1 shows the withdrawn position of the working platform 11. FIG. 2 shows the drawn out position of the working platform 11.

The hinged arm 12 has two sections 17 which are connected together by a joint 16. One of the sections 17 is hinged to the working platform 11, the other section 17 carries the reciprocal hydraulic hammer 13 and its operating ram 23 so that the hinged arm 12 can be flexed about joint axes 18 with the tunneling apparatus 3, 4 in its normal position.

The hammering platform 10 including the hinged arm 12 is also pivotal about a vertical axis 19 on a swivel pivot 20. The working platform 11 including hinged arm 12 can also pivot about through 360° about a horizontal axis. The milling arm 3 with its cutter head 4, the hinged arm 12 with the hydraulic hammer 13, the scoop 5, and the hammering platform 10 with the working platform 11 are controlled by respective hydraulic rams 21*a*, 21*b*, 21*c* and 21*d* motor driven. The milling arm 3 and the outer arm section 17 of the hinged arm 12 are provided with hydraulic actuators for the cutter head 4 and the hammer 13. These various actuators are connected to a hydraulic control unit (not illustrated) whose pump is driven by the motor 20.

I claim:

1. A tunneling apparatus comprising:
   - a track-propelled support displaceable along the floor of a tunnel;
   - an articulated miller arm swingable at one end about a horizontal axis on said support;
   - a rotatable milling head on said miller arm engageable with a lower portion of a face wall of said tunnel;
   - means for rotating said head to mill material away from said lower portion to undercut the upper portion of said wall;
   - a platform above said milling head displaceable toward and away from said face wall;
   - an articulated hammer arm having one section pivoted on said platform and another section pivoted on said one section;
   - a hydraulic hammer on said other section of said hammer arm engageable with said upper portion of said face wall;
   - hydraulic means for reciprocating said hammer to break material off said upper portion;
   - means on said support for transporting material milled away and broken off said wall away from adjacent said wall; and
   - means on said support for swinging said platform and said miller arm independently about respective vertical axes.

2. The apparatus defined in claim 1 wherein said milling head is provided with an arm pivotal about the respective vertical axis on said support.

3. The apparatus defined in claim 1 wherein said means for transporting includes a scoop underneath said head and said hammer and a transport belt extending back past said support from said scoop.

4. The apparatus defined in claim 1 wherein said milling head and said hammer are vertically displaceable into uppermost positions with said hammer above said head.

5. A tunneling apparatus as defined in claim 1, further comprising a hydraulic cylinder device for displacing said platform and connected in a hydraulic circuit with a pump operating the tracks of said support.

* * * * *